US006017204A

United States Patent [19]

Holzapfel et al.

[11] Patent Number: 6,017,204

[45] Date of Patent: Jan. 25, 2000

[54] SPIRAL COMPRESSOR, USEFUL IN PARTICULAR TO GENERATE COMPRESSED AIR FOR RAIL VEHICLES

[75] Inventors: Christian Holzapfel, Lentig; Wilfried Zörner, Weichs; Robert Frank, Germering, all of Germany

[73] Assignee: Knorr-Bremse Systeme Fur Schienenfahrzeuge GmbH, Munich, Germany

[21] Appl. No.: 08/981,568

[22] PCT Filed: Jul. 19, 1996

[86] PCT No.: PCT/DE96/01329

§ 371 Date: Dec. 23, 1997

§ 102(e) Date: Dec. 23, 1997

[87] PCT Pub. No.: WO97/05389

PCT Pub. Date: Feb. 13, 1997

[30] Foreign Application Priority Data

Jul. 31, 1995 [DE] Germany ..... 195 28 005
Feb. 7, 1996 [DE] Germany ..... 196 04 447

[51] Int. Cl.[7] ..... F01C 1/02

[52] U.S. Cl. ..... 418/55.4; 418/55.5; 418/101

[58] Field of Search ..... 418/55.5, 57, 101, 418/55.4

[56] References Cited

U.S. PATENT DOCUMENTS

| | | | |
|---|---|---|---|
| 3,817,664 | 6/1974 | Bennett et al. | 418/57 |
| 5,082,430 | 1/1992 | Güttinger | 418/55.2 |
| 5,098,265 | 3/1992 | Machida et al. | 418/55.2 |

*Primary Examiner*—Thomas Denion
*Assistant Examiner*—Thai-Ba Trieu
*Attorney, Agent, or Firm*—Barnes & Thornburg

[57] ABSTRACT

In a totally oil-free spiral compressor (1) with high suction volume flows and compression ratio, useful in particular to generate compressed air for rail vehicles, the spirals are arranged on one side only and measures are taken to compensate for the high axial forces that act on the spiral bearings. Compression chambers (35) arranged with an axial gap between the spirals (7, 9) of the spiral compressor (1) are fed by compression pockets (45) and support the nested spirals against each other. The compression chambers (35) are preferably arranged between a compression crown (15) joined to the driving spiral (7) and a ring wheel (37) of the forcibly driven second spiral (9), so that axial counterforces compensate for the axial forces that act upon the bearings (29, 33) of both spirals.

7 Claims, 1 Drawing Sheet

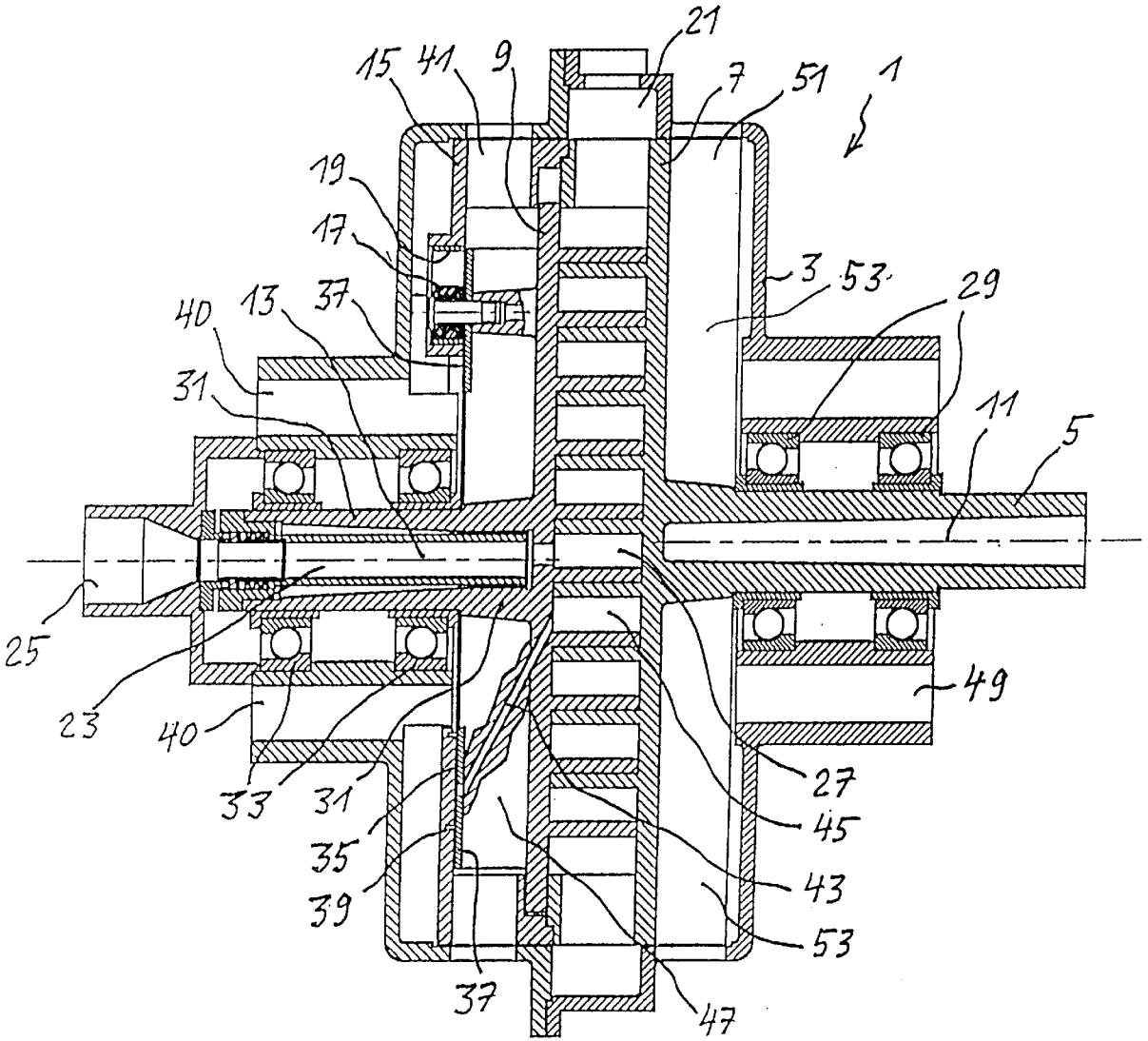
1
3
5
7
9
11
13
15
17
19
21
23
25
27
29
31
33
35
37
39
40
41
43
45
47
49
51
53

SPIRAL COMPRESSOR, USEFUL IN PARTICULAR TO GENERATE COMPRESSED AIR FOR RAIL VEHICLES

BACKGROUND AND SUMMARY OF THE INVENTION

The invention relates generally to a spiral compressor and more specifically to totally oil free spiral compressor.

When generating compressed air, particularly when generating compressed air totally without oil for rail vehicles, special demands must be made on the compressor technique because of the large amounts of air to be generated and the extremely rough conditions. The full operating ability must always be ensured even under rough environmental conditions (temperature, vibrations, shocks, etc.).

In the field of rail vehicles, oil-free spiral compressors are receiving increased attention, particularly for avoiding the occurrence of an oil-containing condensation and for simplifying the maintenance. Because of the capacity (for example, intake volume flow of approximately 1,600 l/min.) which must be increased considerably in comparison to today's commercially available, oil-free spiral compressors for rail vehicles and the connected high stress to the spiral compressor, such compressors cannot merely be enlarged, particularly in view of the very high axial forces which have the tendency to press apart the spirals of the compressor. In the case of a so-called one-sided spiral arrangement, particularly the support of such axial forces presents problems because very large bearings are required. These problems are becoming more serious because of the required oil-free compression, because of which the friction output of the bearings is very difficult to achieve. For the above-mentioned reasons, compressors with a one-sided spiral arrangement have not been considered to be usable in the rail vehicle field.

Based on the above, it is an object of the invention to further develop a preferably completely oil-free operating spiral compressor with a one-sided spiral arrangement with a large intake volume flow as well as under high compression conditions such that the above-mentioned problems of high axial forces are taken into account. In particular, despite the required volume and compression quantities, an operation of the compressor is to be permitted which is free of high axial forces and thus as free of wear as possible.

The achieving of this object include in the case of a one-sided arrangement of the spirals, specifically of the driving and of the pulled-along spiral, as a result of the pressure chambers fed by pressure pockets of the spiral compressor, a device is created in a very simple manner by means of which the very high axial forces which act upon the bearings can be counteracted. A compensation of these axial forces can therefore be achieved. Despite the high rotational speeds of the two spirals, the function of the pressure chambers is ensured particularly in the case of dry running characteristics of the seals bounding the pressure chambers since only a low relative speed exists between the spirals, thus also in the area of the pressure crown and of the ring wheel which, together with the pressure crown, forms the pressure chambers.

Other objects, advantages and novel features of the present invention will become apparent from the following detailed description of the invention when considered in conjunction with the accompanying drawings.

BRIEF DESCRIPTION OF THE PREFERRED EMBODIMENTS

In the following, the invention will be explained by means of an embodiment with reference to the attached single drawing. This drawing is a sectional view of the spiral compressor according to the invention.

DETAILED DESCRIPTION OF THE PREFERRED EMBODIMENTS

The drawing shows a spiral compressor 1 which is provided with a one-sided spiral arrangement and which has an arrangement according to the invention for compensating the high axial forces which act with respect to the bearings of the compressor. The spiral compressor 1 is provided with a housing 3 in which two meshing spirals extend, specifically one spiral 7 driven by a shaft 5 and one spiral 9 pulled by the spiral 7. The two spirals each carry out a pure rotational movement. Because of the purely rotational movement of the spirals, there are no out-of-balance forces if the spirals are each balanced themselves out.

The relative movement of the two spirals with respect to one another required for a compression effect is generated in that the rotational axes 11 and 13 of the two spirals 7 and 9 respectively are offset. Furthermore, a pressure crown 15 reaches around the pulled-along spiral 9, which compression crown 15 is fixedly screwed or otherwise connected with the driven spiral 7 (by way of fastening devices which are not shown). In order to ensure the function of the so-called "co-rotating" principle of the two spirals—that is, in order to ensure at any time the correct relative position of the two spirals with respect to one another—an "antirotational mechanism" in the form of a forced guidance acts between the two spirals. The antirotational mechanism consists, for example, of three supporting rollers 17 which are carried by the pulled-along spiral 9 and which extend in bores 19 in the pressure crown 15 which are arranged at the same angular distance from one another. Accordingly, three bores 19, are assigned to three supporting rollers 17 arranged at an angular distance of 120° respectively with respect to one another. Since the pressure crown 15 rotates with the driven spiral 7, this spiral 7 takes the spiral 9 along by means of the walls of the bores 19 and the supporting rollers 17; that is this spiral 9 is pulled along. In which case, because of the displacement of the axes of rotation, within the degree of freedom of the bores, the two spirals carry out "orbiting" movements with respect to one another. These orbiting movements of the spirals with respect to one another produce between them spiral pockets which change in the volume and which contribute to the compression of the gas or air volume taken in by way of an intake duct 21. The compressed air is pushed out of the compression space 27 through an axial bore 23 situated in the center of the spiral 9 and by a pressure connection piece 25. The driven shaft 5 of the spiral 7 extends in a bearing 29 while the shaft 31 of the pulled-along spiral 9 extends in a bearing 33.

In the case of a spiral compressor of the above-described one-sided spiral arrangement, it is desirable for a completely oil-free running that a high compression ratio is achieved without pronounced stress to the bearings because of the resulting axial forces on the spirals. In order to remedy this problem, an arrangement for compensating the axial forces is provided according to the invention. This arrangement consists of pressure chambers 35 which are provided between the interior side of the pressure crown 15 and a ring wheel 37 mounted on the rear side of the spiral 9. In the illustrated embodiment, the pressure chambers 35 are the very low volumes which exist in each case between the ring wheel 37 and the facing interior surface of the pressure crown 15. The size and the shaping of the pressure chambers is determined by dry-running seals 39 which seal off the pressure chambers with respect to outside air; that is, with respect to the outside-air volume between the cooling air inlet 40 and the cooling air outlet 41 of the spiral 9. In the illustrated embodiment, three pressure chambers 35 are in each case provided at the same angular distance of 120° from one another situated between the bores 19, the pressure chambers 35 are in each case supplied by way of bores 43 with compressed air from the compression pockets 45 of the spirals.

Because of the above-described pressure supply of the pressure chambers 35, a pressure is built up in these pressure chambers during the operation of the spiral compressor. The pressure presses the two spirals towards one another because the pressure crown 15 is connected with the spiral 7 and the ring wheel 37 is carried in the rearward area of the spiral 9 by this spiral, for example, by radial cooling ribs 47 connected with the spiral 9 or by the bearing pins of the supporting rollers 17 which penetrate the ring wheel 37 at an angular distance from one another, as illustrated in the upper sectional half of the drawing. Since, by means of the above-described arrangement for the axial force compensation, the spirals 7 and 9 are pressed towards one another, the bearings 29 and 33 are relieved from axial forces to the same extent, which is why oil-free operating spiral compressors of the described type can also operate at a high compression ratio in the case of a high intake volume.

In addition to the above-mentioned cooling air arrangement for the spiral 9, a corresponding cooling system is also provided on the spiral 7; that is, there is a cooling air inlet 49 and a cooling air outlet 51. In addition, radial cooling ribs 53 are provided which are connected with the spiral 7.

We claim:

1. An oil-free operating spiral compressor, used for generating compressed air for rail vehicles, having at least a first and second spirals which are arranged in a housing, extend in one another, are each carried by a bearing and whose relative movement with respect to one another required for the compression effect is generated by a mutual displacement of their axes of rotation, for the purpose of the compensation of the axial forces exercised by the spirals onto the bearings on the interior side of a pressure crown connected with the first spiral which extend in one another, pressure chambers are provided which, under the effect of pressure of the compressed air fed by the spiral compressor, press the two spirals towards one another for the purpose of relieving the bearings wherein a. the pressure chambers are formed between an interior side of the pressure crown and a ring wheel resting against the pressure crown, b. on a side facing away from the pressure chambers, the ring wheel is supported on radial cooling ribs connected with the second spiral, and c. the pressure chambers are fed with compressed air by way of bores extending through the cooling ribs and by way of passages in the ring wheel by compression pockets of the spiral compressor.

2. An oil-free operating spiral compressor according to claim 1, wherein a. the pressure chambers are each bounded by a pressure chamber seal with dry-running characteristics embedded in the pressure crown, and b. the ring wheel overlaps the pressure chambers at a sliding speed corresponding to the relative speed between the two spirals.

3. An oil-free operating spiral compressor according to claim 1 wherein three pressure chambers are between the interior surface of the pressure crown and the facing interior surface of the ring wheel which are at an angular distance of 120° respectively with respect to one another.

4. An oil-free operating spiral compressor according to claim 1 wherein the first spiral is driven and the second spiral is pulled along by the first spiral by a forced guidance.

5. An oil-free operating spiral compressor according to claim 4, wherein a. rotatably displaced supporting rollers extend from the rear of the second spiral facing the pressure crown, and b. the supporting rollers are in bores which are entered into the pressure crown.

6. An oil-free operating spiral compressor according to claim 5, wherein three supporting rollers which are arranged at angular distance of 120° with respect to one another on the rear of the second spiral, extend away from the second spiral and each roll in the bores of the pressure crown are connected with the first spiral.

7. An oil-free operating spiral compressor according to claim 5, wherein the supporting rollers and the pressure chambers are alternately arranged on a graduated circle.

* * * * *